United States Patent [19]

Czech

[11] 4,421,255

[45] Dec. 20, 1983

[54] DISPENSER FOR PASTY PRODUCTS

[76] Inventor: Joachim Czech, Jahnstrasse 19, D-8405 Donaustauf, Fed. Rep. of Germany

[21] Appl. No.: 202,725

[22] Filed: Oct. 31, 1980

[30] Foreign Application Priority Data

Nov. 9, 1979 [DE] Fed. Rep. of Germany ..... 2945338

[51] Int. Cl.[3] ..... B67D 5/42

[52] U.S. Cl. ..... 222/387; 222/391

[58] Field of Search ..... 222/387, 505, 391, 389, 222/494, 212

[56] References Cited

U.S. PATENT DOCUMENTS

| | | | |
|---|---|---|---|
| 1,950,099 | 3/1934 | Cornnell, Jr. et al. | 222/391 |
| 2,356,874 | 8/1944 | Nageotte | 222/391 X |
| 2,507,248 | 5/1950 | Swart | 222/494 |
| 2,604,858 | 7/1952 | Bosa | 222/391 X |
| 2,623,659 | 12/1952 | Gadelius | 222/391 X |
| 2,784,603 | 3/1957 | Collins | 222/391 X |
| 3,215,320 | 11/1965 | Heisler | 222/391 |
| 3,255,935 | 6/1966 | Spatz | 222/391 X |
| 4,154,371 | 5/1979 | Kolaczinski et al. | 222/494 X |

*Primary Examiner*—Stanley H. Tollberg
*Attorney, Agent, or Firm*—James E. Nilles

[57] ABSTRACT

A dispenser for pasty products has a cylindrical body with an open bottom and an outlet in its top. A piston that closes the bottom of the body, cooperating with it to define a chamber, is slidable upward in the body for expelling contents of the chamber out of the outlet. An actuator on the exterior of the body, movable in opposite directions, is manually movable to one limit of its motion and biased to the other limit. A rod connected with the actuator and movable lengthwise up and down in the body has a unidirectional driving connection with the piston that constrains the piston to move upward with it but allows it to move down relative to the piston. A check valve associated with the outlet opens to allow discharge of chamber contents but closes to block flow into the chamber, thus enabling atmospheric pressure to hold the piston against downward motion. Several advantageous unidirectional connections are disclosed.

2 Claims, 10 Drawing Figures

DISPENSER FOR PASTY PRODUCTS

FIELD OF THE INVENTION

This invention relates to a dispenser for pasty products, of the type comprising a cylindrical container, a piston movable in one direction in the container for forcing container contents through an outlet, a manually operable actuator that is movable back and forth between defined limits, and a lengthwise slidable rod that extends through a relatively fixed end wall of the container and serves to transmit to the piston motion of the actuator in one direction but not in the other, so as to cause a predetermined quantity of container contents to be discharged through the outlet each time the actuator is cycled from one to the other of its limits of motion and back again. The invention is more particularly concerned with means for preventing opposite-direction movement of the piston from any position to which it has been brought.

BACKGROUND OF THE INVENTION

U.S. Pat. No. 3,255,935 discloses a dispenser of the general type to which this invention relates. In the device of that patent, the piston is moved upwardly to force material out of the container, and for such motion the piston has a unidirectional driving connection with a rod that is in turn connected with a manually operable actuator. The unidirectional driving connection comprises a first set of four resilient tongues that have respective captive ends secured to the piston at its bottom. These tongues, which are arranged in diametrically opposite pairs, project obliquely downwardly from the piston and towards one another to have their free ends engaged under resilient bias against the rod. They thus constrain the piston to move in its upward discharge direction with the rod but permit the rod to slide downward relative to the piston. To confine the piston against downward displacement from any position to which it has been raised, four resilient tongues of a second set are attached to its bottom, likewise in diametrically opposite pairs, and these project obliquely downwardly and radially outwardly from the piston to have their free ends engaged under resilient bias against the inner surface of the cylindrical container wall.

This known dispenser has an actuator in the form of a push button that is accessible at its exterior and is connected with the upper end of the rod. When the push button is forced down, the rod moves downward with it, but the unidirectional driving connection comprising the first set of tongues allows the piston to remain stationary, restrained against downward motion by the tongues of the second set in their cooperation with the container wall.

This prior dispenser has the disadvantage that its tongues, which are formed integrally with a ring, must be produced very accurately with respect to both their dimensions and their biasing force, because otherwise easy actuation of the dispenser is not possible. If, for example, the tongues that engage the container wall exert too much spring force against it, the return spring in the push button will not be powerful enough to drive the piston in its discharge direction against the friction that those tongues produce by their engagement with the container wall. If, on the other hand, the length of those tongues is not held precisely, then there is a danger that when the rod moves downward it can draw the piston down with it, due to engagement of the rod against the surface of the hole in the piston through which it extends, and because the tongues of the second set, which are intended to engage the container wall, fail to bite into it owing to their excessive length. Corresponding problems are presented when the tongues of the first set are faulty with respect to their dimensions or spring forces.

SUMMARY OF THE INVENTION

The general object of the present invention is to provide a dispenser of the general type described above but having very simple means for preventing the piston from moving down from any position to which it has been raised, and wherein the rod and the piston are securely connected with one another for upward movement during every actuation.

In general, this object of the invention is achieved in a dispenser of the character described wherein the means for preventing movement of the piston oppositely to its discharge direction comprises a check valve associated with the outlet of the container, and wherein the coupling between the actuating device and the piston comprises a rod that is lengthwise movable in the container and a device that provides a unidirectional driving connection between said rod and the piston. With this arrangement, the piston is effectively confined by atmospheric pressure against retrograde motion—that is, motion in the direction opposite to the discharge direction—but it is nevertheless freely movable in the discharge direction by means of the rod.

An advantage of the arrangement is that the check valve can be very inexpensively manufactured in large volume as a plastic injection molding.

A further advantage is that the check valve prevents drying and contamination of the undischarged contents of the dispenser.

Other advantages of the invention and of specific embodiments of it that are disclosed herein will appear as the description proceeds.

BRIEF DESCRIPTION OF DRAWINGS

In the accompanying drawings, which illustrate what are now regarded as the preferred modes of embodying the invention, but which are examples of the many forms in which the principles of the invention can be embodied.

DETAILED DESCRIPTION OF PREFERRED EMBODIMENTS OF THE INVENTION

Figure 1:
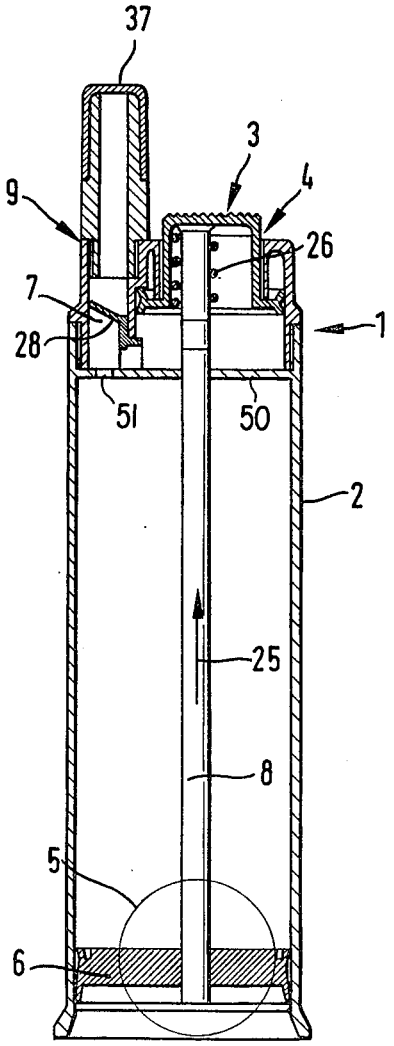
FIG. 1 is a schematic view in longitudinal section of a dispenser made in accordance with the principles of this invention.

The dispenser 1 that is schematically illustrated in the accompanying drawings comprises a container body 2 which is shown as cylindrical, open at a bottom end and closed at an upper end thereof by a top wall 50 in which there is an outlet opening 51. The open bottom of the container body 2 is closed by a piston 6 which cooperates with the body 2 to define a chamber for pasty material to be dispensed and which is slidable upwardly in the body, in contact with its cylindrical side wall, to force the contents of the chamber out through the opening 51. The piston is moved in its upward discharging direction, denoted by the arrow 25, by means of an actuating device 3 on the exterior of the container. The actuating device 3 is illustrated in FIG. 1 as a push button 4 that is manually movable downwardly and is biased upward by a return spring 26 which is housed in its hollow interior and which reacts between the push button and the upper end wall 50 of the dispenser body.

Motion of the push button 4 is imparted to a rod 8 that extends through the upper end wall 50 and has its upper end connected to the push button. The rod thus moves lengthwise up and down in unison with the push button 4. However, owing to a unidirectional driving connection 5 between the rod 8 and the piston 6, the latter is constrained to move upward with the rod but the rod is free to move downward relative to the piston. Since the push button 4 is movable up and down between defined limits, each cycle of push button motion from its upper to its lower limit and back again results in movement of the piston 6 through a predetermined distance in its discharging direction 25 and thus results in discharge of a predetermined quantity of the container contents. Note that in the FIG. 1 embodiment it is the force of the return spring 26 that drives the piston 6 in its discharging direction 25, and therefore no material issues from the dispenser 1 until the push button 4 is released after a manual downward actuation.

On the top of the body 2 there is a nozzle 9 or the like that defines an outlet passage leading from the outlet opening 51. A check valve 7 that is associated with the outlet is preferably located in the nozzle 9. The check valve 7 is arranged to open in response to flow of material out of the outlet 51 and to prevent inward flow through the outlet. By thus preventing air from entering the chamber conjointly defined by the body 2 and the piston 6, the check valve 7 enables atmospheric pressure to hold the piston 6 against retrograde motion. At the same time, the check valve 7 prevents the contents of the container from being dried out or contaminated. A closure cap 37 can be removably fitted on the nozzle 9 for further protection of the container contents and to prevent leakage out of the nozzle of material therein that has passed the check valve.

Obviously, the check valve 7 could take the form of a ball valve, but as preferred, and as shown, it comprises a swingable flap 28 that can be readily formed as a plastic injection-molded element of a type that will be readily understood by those acquainted with the art.

Figure 2:
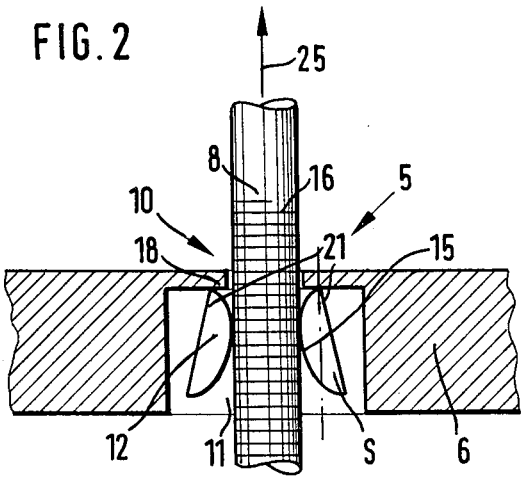
FIG. 2 is a detail view in longitudinal section showing a first form of unidirectional driving connection between the rod and the piston, comprising a friction ratchet with swingable ratchet members.

One form of unidirectional driving connection between the rod 8 and the piston 6 is illustrated in FIG. 2, wherein the connection means takes the form of a friction ratchet 10 that is located in a cavity 11 in the piston. In this case the cavity 11 is defined by a substantially concentric enlargement of the bore in the piston through which the rod 8 extends. The friction ratchet 10 comprises a ratchet member 12 in the form of a friction block that is connected with the piston for rotation about a pivot 21 which extends transversely to the coinciding axes of the rod 8 and the piston 6 and which is above the center of gravity S of the friction block 12. In this case, the friction block has a convexly curved friction surface 15 at its side adjacent to the rod 8. Its center of gravity S is spaced at a greater distance from the axis of the rod 8 than the pivot 21 about which it swings, and it is thus gravity biased for maintenance of its friction surface 15 in contact with the rod 8.

In this case two identical friction blocks 12 are shown, having like pivotal connections to the piston 6 and located at opposite sides of the rod 8. It is possible, however, to employ only one such friction block or more than two of them. In the illustrated example the surface of the rod 8 has transversely extending depressions or grooves 16 at intervals along its length to afford a secure frictional connection with the friction block or friction blocks 8 during upward movement of the rod. It will be apparent that two friction blocks 12, arranged as shown in FIG. 2, not only provide for a frictional connection between the rod 8 and the piston 6 but also cooperate to clamp the rod during its upward movement, ensuring that the piston will partake of all motion of the rod in the discharging direction 25. Of course, when the rod 8 moves down, the friction blocks 12 immediately release their clamping grip on the rod and slide lightly along it, permitting force downward motion of the rod relative to the piston 6.

At the side of the piston 6 that is adjacent to the container contents, the piston is formed with a sealing collar 18 that closely surrounds the rod 8 and serves to prevent air from leaking into the interior of the container through the cavity 11.

Figure 3:
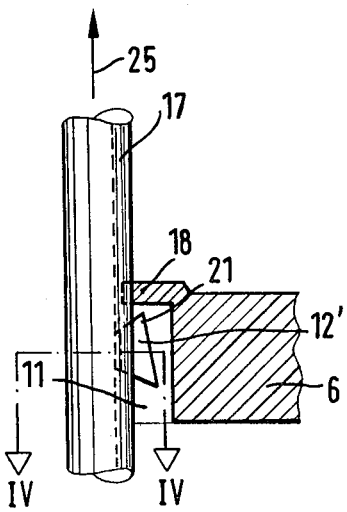
FIG. 3 is a detail view in longitudinal section showing a second form of unidirectional driving connection, comprising a modified version of the friction ratchet shown in FIG. 2.
Figure 4:
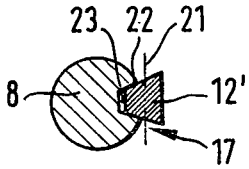
FIG. 4 is a sectional view taken on the plane of the line IV—IV in FIG. 3.

A second embodiment of the unidirectional connection means 5, illustrated in FIG. 3, also comprises a friction ratchet, but in this case the friction block 12' is wedge-shaped or keystone-shaped as viewed along the axis of the rod 8, and the rod 8 has a groove 17 that extends along its entire length and has a radially outwardly divergent cross section which mates with the keystone-shaped configuration of the friction block 12'. The friction block 12' is again pivoted to the piston 6 to swing about an axis 21 that is above its center of gravity. During upward movement of the rod 8, the wedge defining side surfaces 22 of the friction block 12' come into friction-connecting as well as clamping engagement with their respectively opposing side flanks 23 of the groove 17, as can be seen from FIG. 4. This connection is immediately released as soon as the rod 8 moves downward. In this embodiment, as in those described hereinafter, the piston 6 is again equipped with a sealing collar 18 at its side facing the container contents, to seal off the interior of the container from the atmosphere.

Figure 5:
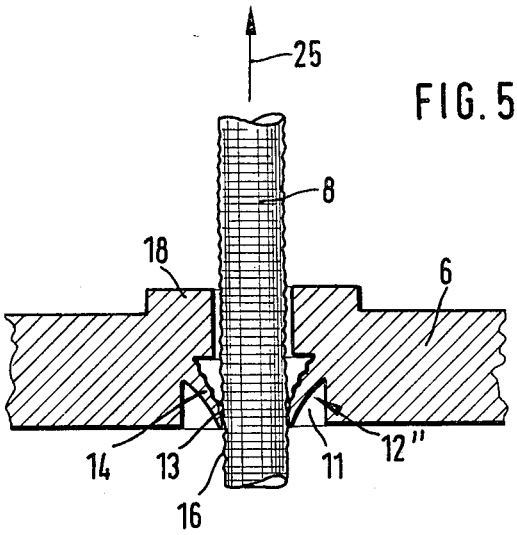
FIG. 5 is a detail view in longitudinal section showing a third form of unidirectional driving connection comprising a friction ratchet having a protuberance element integral with the piston.

FIG. 5 illustrates a third embodiment of the unidirectional driving connection that also comprises a friction ratchet. In this case the ratchet member 12'' is formed as a resilient protuberance or tongue 14 on the piston 6 that projects obliquely downwardly in the cavity 11 and at a radially inward inclination, to have its free end engage the rod 8 under bias so that upon movement of the rod in the discharge direction 25 there is produced an operative friction connection between the piston and the rod. As illustrated in FIG. 5, there are two of the protuberances or tongues 14, disposed diametrically opposite one another for clamping cooperation with the rod, and the rod again has transverse grooves 16 to ensure a good frictional connection. To increase the effectiveness of the coupling connection between the rod 8 and the piston 6, the surface of each protuberance 14 that is adjacent to the rod can be formed with ridges 13 that tend to mate with the grooves 16. Instead of one or more separate protuberances 14, it is also possible to form the protuberance as a type of tapered sleeve which completely surrounds the rod.

Figure 6A:
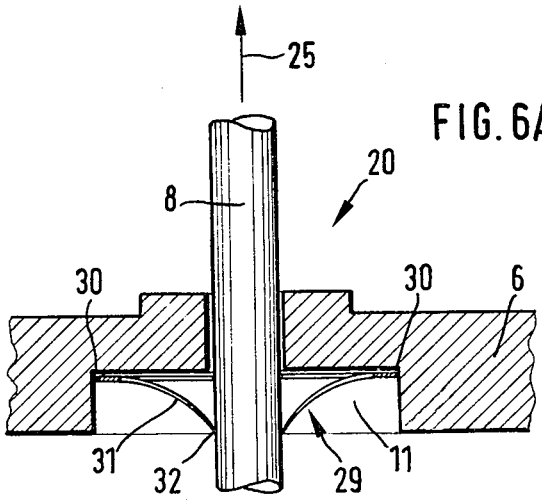
FIG. 6*a* illustrates a fourth embodiment of the unidirectional driving connection, comprising a form-connecting ratchet.
Figure 6B:
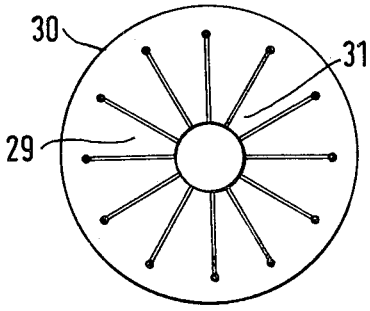
FIG. 6*b* is a plan view of the spring plate in the embodiment of FIG. 6*a*.

FIG. 6*a* illustrates a fourth embodiment wherein the unidirectional driving connection is a form-connecting ratchet 20 comprising a resilient plate-like member (as best seen in FIG. 6*b*) having a plurality of radially extending tongues 29. Said tongues are integrally connected at their outer ends 30 to a ring-like peripheral portion of the member that is secured to the underside of the piston 6, within the cavity 11. The inner end portions 31 of these tongues 29 cooperate to define a central aperture in the plate-like member that has a smaller diameter than the rod 8. Thus, when the rod 8 is received in the central aperture just mentioned, it bowingly deflects the inner end portions 31 of all of the tongues, to dispose their radially inner end edges 32 at a level below that of their connected outer ends, so that each of the inner end edges 32 bears against the rod 8 under resilient bias.

Figure 7:
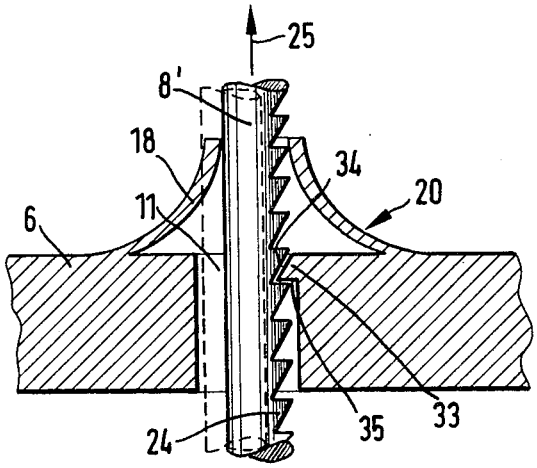
FIG. 7 illustrates a fifth embodiment of the unidirectional driving connection, as an alternative form-connecting ratchet.

FIG. 7 illustrates a fifth variant of the unidirectional driving connection device, which can be considered an alternative to the form-connecting ratchet shown in FIGS. 6*a*–6*b*. In this case, a protuberance 33 on the piston 6, which can be formed integrally with the piston, projects into the cavity 11. The rod 8 is formed as a ratchet rack 8', with ratchet teeth 24, and the probuberance 33 cooperates with the ratchet teeth 24. Accordingly, the protuberance has an inclined camming surface 34 that faces obliquely in the discharging direction and towards the rod 8 and has an abutment surface 35 that is substantially normal to the rod axis and faces oppositely to the discharging direction. The teeth 24 of the rod 8 have inclined camming surfaces which face obliquely in the direction opposite to that of discharge and which thus oppose the camming surface 34 on the protuberance 33. In this embodiment the sealing collar 18 is resilient, and by its engagement with the rod 8 is not only provides a seal around the rod but also biases the rod 8 laterally relative to the piston in the direction that tends to maintain the protuberance 33 engaged with the teeth 24.

Figure 8:
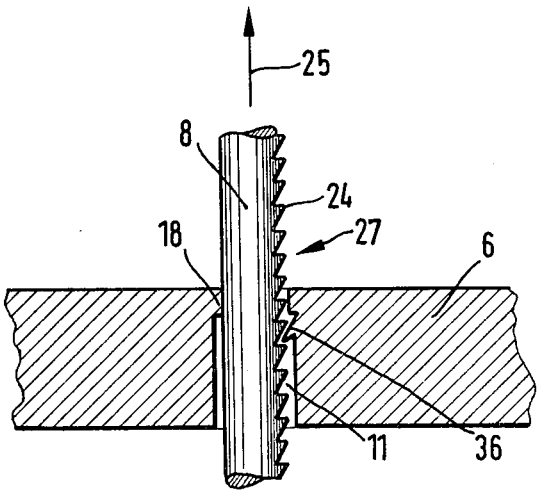
FIG. 8 illustrates a sixth embodiment of the unidirectional driving connection, comprising a claw ratchet.

FIG. 8 illustrates a sixth embodiment of the unidirectional connecting device, comprising a claw ratchet 27. The piston 6 in this case has a claw-like protuberance 36 which can be formed integrally with it and which is resilient. The protuberance 36 projects obliquely downwardly and towards the rod 8 for cooperation with ratchet teeth 24 on the rod. Thus the rod 8 is formed as a ratchet rack 8', essentially like the rod of the FIG. 7 embodiment. If the rod 8 of the FIG. 8 embodiment is moved downward, the inclined surfaces of its teeth 24 cammingly repel the resilient claw 36, allowing the rod to move down relative to the piston 6, whereas during upward movement of the rod 8 the protuberance 36 hookingly engages one of the teeth 24 on the rod, compelling the piston to move with the rod in the upward discharge direction 25.

Figure 9:
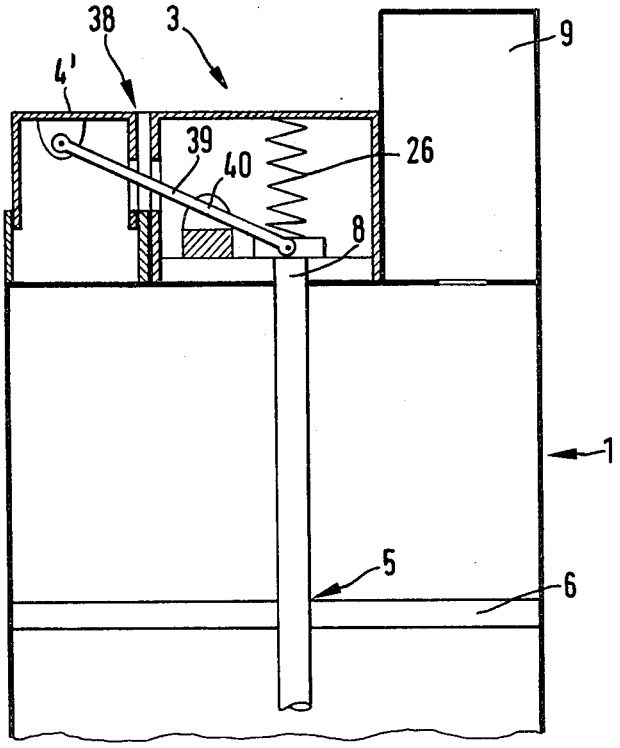
FIG. 9 is a view in longitudinal section of the upper portion of a modified embodiment of the invention, having a lever connection between its push button and its piston actuating rod.

In the embodiment of the dispenser of this invention that is illustrated in FIG. 9, the actuating device 3 comprises a lever mechanism 38, having a lever 39 swingably mounted on a medial fulcrum 40. The opposite ends of the lever 39 have respective pivot connections to the push button 4' and to an upper end portion of the rod 8. The resetting spring 26 reacts between the upper end of the rod 8 and the container body to urge the rod downward and, through the lever 39, to bias the push button 4' upward. Pushing down on the push button 4' moves the rod 8 in the upward discharging direction, and of course the piston 6 moves up with the rod 8 to force material out of the container outlet 9. This material is dispensed from the container on the manually actuated stroke of the push button 4' instead of during a spring-propelled return stroke as in the FIG. 1 embodiment.

The invention can be embodied in other forms than those described above. For example, with certain container forms it may be desirable to use plural rods that are connectable to the piston by unidirectional connection means. The dispenser could also be so constructed that the dispensing outlet would be in a lower portion of the container, rather than in its upper portion, and accordingly the piston would be moved in a downward discharging direction and the unidirectional connection means would correspondingly be arranged at its other side.

What is claimed as the invention is:

1. A dispensing container for viscous materials comprising: a hollow body that has a side wall and an end wall, a piston which cooperates with said body to define a chamber and which is slidable in one direction in said body in contact with said side wall to force viscous materials in said chamber out of the same through a dispensing outlet in a part of said body, a manually movable actuator located at the end of said body nearest side end wall and accessible at the exterior of said body for manual actuation in a direction against a bias in an opposition direction, an axially movable rod which extends through said end wall, a lever forming a connection between said actuator and said rod that constrains said rod to move in unison with but in an opposite direction from said actuator, whereby actuation of said actuator in said opposite direction imparts motion to said rod in said one direction, motion transmitting means providing a unidirectional driving connection betwee said rod and said piston whereby said rod is allowed to move relative to said piston in a direction opposite to said one direction, but said piston is constrained to move with said rod in said one direction, and a check valve operatively associated with said dispensing outlet and arranged to permit flow of viscous material out of said chamber but to block flow of air into said chamber so that atmospheric pressure confines said piston against motion in said opposite direction relative to said body.

2. A dispensing container for viscous materials comprising: a hollow body that has a side wall and an end wall, a piston which cooperates with said body to define a chamber and which is slidable in one direction in said body in contact with said side wall to force viscous materials in said chamber out of the same through a dispensing outlet in a part of said body, said piston having a substantially axially extending hole therethrough, an actuator located at the end of said body nearest said end wall and accessible at the exterior of said body for manual actuation in a direction against a bias in an opposite direction, an axially movable rod which extends through said end wall and through said hole in said piston and which has a connection with said actuator that constrains said rod to move in unison with said actuator, said connection of said rod with said actuator comprising a lever whereby actuation of said actuator in said opposite direction imparts motion to said rod in said one direction, motion transmitting and motion constraining means comprising releasably engageable means on said piston and on said rod and located near said hole in said piston and connectable solely between said rod and said piston for providing a unidirectional driving connection between said rod and said piston whereby said rod is allowed to move relative to said piston in a direction opposite to said one direction, but said piston is constrained to move with said rod in said one direction, and a check valve operatively associated with said dispensing outlet and arranged to permit flow of viscous material out of said chamber but to block flow of air into said chamber so that atmospheric pressure confines said piston against motion in said opposite direction relative to said body.

* * * * *